US012590389B2

(12) United States Patent
O'Sullivan

(10) Patent No.: US 12,590,389 B2
(45) Date of Patent: Mar. 31, 2026

(54) METHOD FOR MANUFACTURING KNIT ARTICLES INCORPORATING REFLECTIVE YARN AND KNIT ARTICLES

(71) Applicant: Reebok International Limited, Altrincham (GB)

(72) Inventor: Patrick S. O'Sullivan, Weymouth, MA (US)

(73) Assignee: Reebok International Limited, Altrincham (GB)

( * ) Notice: Subject to any disclaimer, the term of this patent is extended or adjusted under 35 U.S.C. 154(b) by 0 days.

(21) Appl. No.: 16/447,662

(22) Filed: Jun. 20, 2019

(65) Prior Publication Data

US 2020/0399798 A1 Dec. 24, 2020

(51) Int. Cl.

| | |
|---|---|
| ***D04B 1/24*** | (2006.01) |
| ***A41D 1/08*** | (2018.01) |
| ***A41D 31/32*** | (2019.01) |
| ***D04B 1/12*** | (2006.01) |
| ***D04B 15/84*** | (2006.01) |
| *A41D 31/08* | (2019.01) |

(52) U.S. Cl.

CPC ..... *D04B 1/243* (2013.01); *A41D 1/08* (2013.01); *A41D 31/32* (2019.02); *D04B 1/12* (2013.01); *D04B 15/84* (2013.01); *A41D 31/08* (2019.02); *A41D 2500/10* (2013.01); *D10B 2401/20* (2013.01); *D10B 2501/00* (2013.01)

(58) Field of Classification Search

CPC ..... D04B 1/243; D04B 1/12; D04B 15/84; D10B 2401/20; D10B 2501/00; A41D 31/32; A41D 31/08; A41D 2500/10

USPC ..... 66/171

See application file for complete search history.

(56) References Cited

U.S. PATENT DOCUMENTS

| | | | | | |
|---|---|---|---|---|---|
| 4,023,384 | A * | 5/1977 | Conti | D04B 9/46 | 66/172 E |
| 4,702,091 | A * | 10/1987 | Good | D04B 1/26 | 66/171 |
| 4,875,241 | A * | 10/1989 | Browder, Jr. | A41B 11/14 | 2/409 |
| 5,280,652 | A * | 1/1994 | Davis | D04B 1/106 | 2/409 |
| 5,572,888 | A * | 11/1996 | Browder, Jr | D04B 1/18 | 2/401 |
| 5,590,548 | A * | 1/1997 | Osborne | A41B 9/04 | 2/401 |
| 7,017,376 | B2 * | 3/2006 | Meckley | D04B 1/102 | 66/171 |
| 9,554,600 | B2 * | 1/2017 | Mitchell | D04B 1/24 | |
| 9,689,091 | B2 * | 6/2017 | Liao | D04B 1/12 | |
| 10,982,359 | B2 * | 4/2021 | Roe | D04B 1/108 | |

(Continued)

*Primary Examiner* — Alissa J Tompkins
*Assistant Examiner* — Dakota Marin
(74) *Attorney, Agent, or Firm* — STERNE, KESSLER, GOLDSTEIN & FOX P.L.L.C.

(57) ABSTRACT

A method of manufacturing a knit article having a reflective yarn. The method includes knitting an article using a first yarn, and knitting a reflective yarn into a first region of the article using a float plaiting stitch. The method further includes cutting the article incorporating the reflective yarn according to a predetermined pattern to form a cut knit article having a first edge and an opposing second edge, and joining the first edge of the cut knit article to the second edge of the cut knit article.

21 Claims, 7 Drawing Sheets

(56) References Cited

U.S. PATENT DOCUMENTS

| | | | | |
|---|---|---|---|---|
| 2008/0163952 | A1* | 7/2008 | Huang | D03D 15/00 139/317 |
| 2011/0132040 | A1* | 6/2011 | Jahn | D04B 1/243 66/202 |
| 2012/0036897 | A1* | 2/2012 | Chung | D04B 1/16 66/8 |
| 2016/0302527 | A1* | 10/2016 | Meir | D04B 1/102 |
| 2016/0340811 | A1* | 11/2016 | Roe | A41B 11/005 |
| 2018/0125159 | A1* | 5/2018 | Adami | A43B 13/04 |
| 2019/0223556 | A1* | 7/2019 | Aceves Tinajero | D04B 1/102 |
| 2020/0102675 | A1* | 4/2020 | Nyg | D04B 1/243 |

* cited by examiner

METHOD FOR MANUFACTURING KNIT ARTICLES INCORPORATING REFLECTIVE YARN AND KNIT ARTICLES

FIELD

Embodiments described herein generally relate to knit articles. Specifically, embodiments described herein relate to methods for manufacturing a knit article having a reflective yarn incorporated in a region of the knit article.

BACKGROUND

Many people enjoy participating in outdoor activities during periods of low light, such as in the early morning, in the evening, or at night. For example, some people may enjoy walking outdoors for exercise or for walking a pet. Others may enjoy exercising outdoors, such as going running, jogging, bike riding, skateboarding, or roller-skating, among various other activities. However, when participating in outdoor activities during periods of low light, pedestrians may be less visible to motorists, bikers, and other pedestrians, increasing the risk of the pedestrian being involved in a collision or other accident resulting from poor visibility. In order to improve the visibility, and thus the safety of the pedestrian, the pedestrian may wear garments that are bright or reflective in order to allow the pedestrian to be more readily noticed by others in the area. However, such reflective garments may not be comfortable or aesthetically appealing, and may not have the desired performance characteristics, such as stretchability and air permeability, required for athletic pursuits.

Thus, a continuing need exists in the art for apparel having reflective material, and particularly for apparel such as sportswear or athletic wear.

BRIEF SUMMARY OF THE INVENTION

Some embodiments are directed to a method of manufacturing a knit article having a reflective yarn that includes knitting an article using a first yarn, knitting a reflective yarn into a first region of the article using a float plaiting stitch, cutting the article that includes the reflective yarn according to a predetermined pattern to form a cut knit article having a first edge and an opposing second edge, and joining the first edge to the second edge of the cut knit article.

Some embodiments are directed to a method of manufacturing a knit article having a reflective yarn that includes knitting an article using a first yarn having a first modulus of elasticity, and a reflective yarn having a second modulus of elasticity that is less than the first modulus of elasticity, wherein the reflective yarn is knit into the article using a float plaiting stitch, cutting the article having the reflective yarn according to a predetermined pattern to form a cut knit article having a first edge and an opposing, second edge, and joining the first edge to the second edge of the cut knit article.

Some embodiments are directed to a knit article that includes a knit layer having a first yarn and a second yarn, wherein the knit layer has a jacquard pattern, and which further includes a reflective yarn knit into a first region of the knit layer along a course of the knit layer by a float plaiting stitch, wherein the first yarn has a first modulus of elasticity and the reflective yarn has a second modulus of elasticity that is less than the first modulus of elasticity.

In any of the various embodiments discussed herein, the article may be formed by circular knitting.

In any of the various embodiments discussed herein, the article may be formed by weft knitting.

In any of the various embodiments discussed herein, knitting the article may include knitting using a first yarn and a second yarn. In some embodiments, knitting the article may further include knitting a jacquard pattern.

In any of the various embodiments discussed herein, the article may be a sleeve or a legging. In some embodiments, the legging may include a welt stitch at a lower end of the legging.

In any of the various embodiments discussed herein, the first yarn may have a first modulus of elasticity and the reflective yarn may have a second modulus of elasticity that is less than the first modulus of elasticity.

In any of the various embodiments discussed herein, knitting the reflective yarn may be performed using a float plaiting stitch such that a ratio of stitch positions to float positions is 1:1 to 1:6.

In any of the various embodiments discussed herein, the method may further include knitting the reflective yarn into the knit article along a course of the article. In some embodiments, the method may further include knitting a reflective yarn into the knit article along a first course of the article, and knitting a reflective yarn into the knit article along a second course of the article, wherein the first course and the second course are spaced from one another by at least one additional course.

In any of the various embodiments discussed herein, the first edge and the second edge of the cut knit article may be joined by a seam.

In any of the various embodiments discussed herein, the method may further include plaiting the first region of the article using a plaiting yarn.

In any of the various embodiments discussed herein, a first region of a knit layer may include a plaiting yarn on a technical back of the knit layer.

BRIEF DESCRIPTION OF THE DRAWINGS/FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION OF THE INVENTION

Figure 1A:
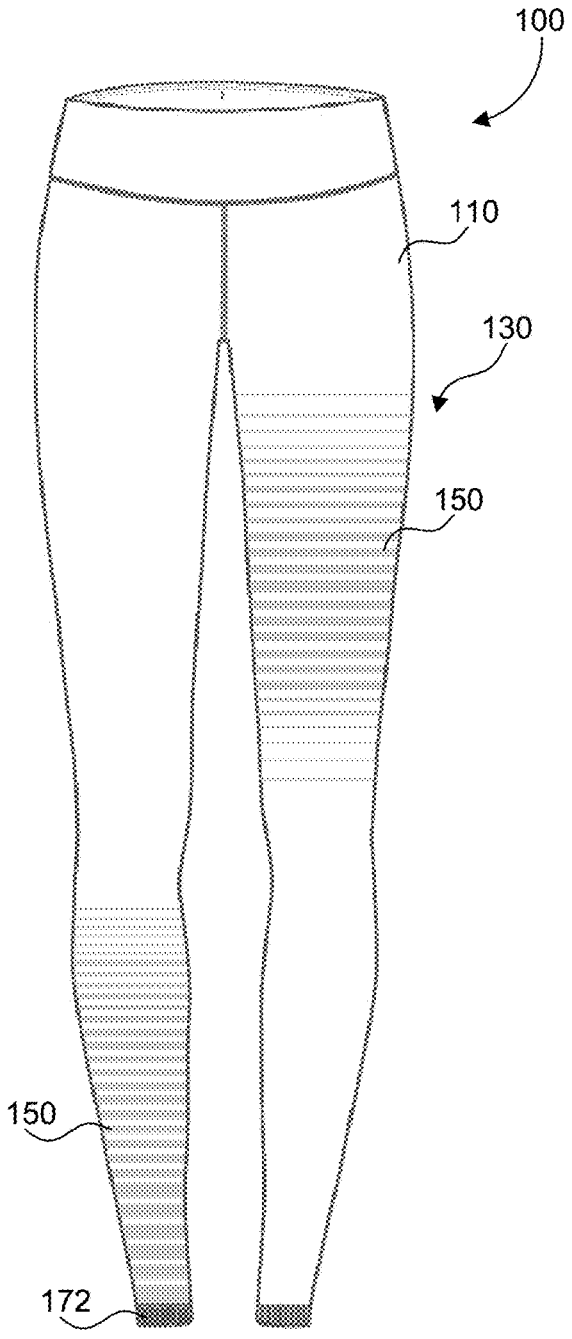
FIG. 1A shows a front view of a knit article formed as leggings according to an embodiment.

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring aspects of the disclosure.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present disclosure. Other suitable modifications and adaptations of the variety of conditions and parameters normally encountered in the field, and which would be apparent to those skilled in the art, are within the spirit and scope of the disclosure.

Reflective garments may be worn in order to improve the visibility of pedestrians and athletes during periods of low light. However, such reflective garments may not be comfortable or well-suited to be worn while exercising. For example, reflective vests may not be aesthetically pleasing and may restrict the wearer's movements or may otherwise interfere with freedom of motion.

Knit garments may provide improved properties relative to other types of garments. Knitted fabrics may be lightweight and stretchable. Additionally, knitting also allows for numerous ways to engineer properties of the knitted fabric. Different knitting patterns can be knitted with different structural stability, stretchability or elasticity, and weight per unit area. Knit garments may be well suited to be worn while exercising as knit garments can be manufactured so as to be lightweight, breathable and stretchable.

In order to retain these performance attributes of knit garments, it would be desirable to knit the garment using reflective yarns as well as conventional yarns so that the resulting garment is reflective to improve visibility without negatively impacting performance attributes of the garment.

However, knitting a reflective yarn into a garment can be problematic. Reflective yarn generally has a lower elasticity (and a greater rigidity or stiffness) than yarn used to prepare the remainder of the garment. Thus, knitting an article using the reflective yarn may be more difficult due to the relative rigidity or stiffness of the reflective yarn. Even if the reflective yarn is used to prepare the knit article, the resulting knit article incorporating the reflective yarn may have less flexibility and greater stiffness due to incorporation of the reflective yarn.

In some embodiments, the present invention relates to knit articles that include a reflective yarn while maintaining flexibility and stretchability of the knit article. In some embodiments, the present invention relates to a method for manufacturing a knit article that includes a reflective yarn, wherein the method allows the knit article to retain its flexibility and stretchability while incorporating the reflective yarn.

Some embodiments described herein relate to a method for manufacturing a knit article having a reflective yarn that includes knitting a knit article using a first yarn, and knitting a reflective yarn into a region of the knit article by float plaiting stitching. The knit article incorporating the reflective yarn may be cut according to a pattern to produce a cut knit article having the desired shape to produce a garment or a portion of a garment. Edges of the cut knit article may then be joined to produce the knit article having reflective yarn.

Figure 1B:
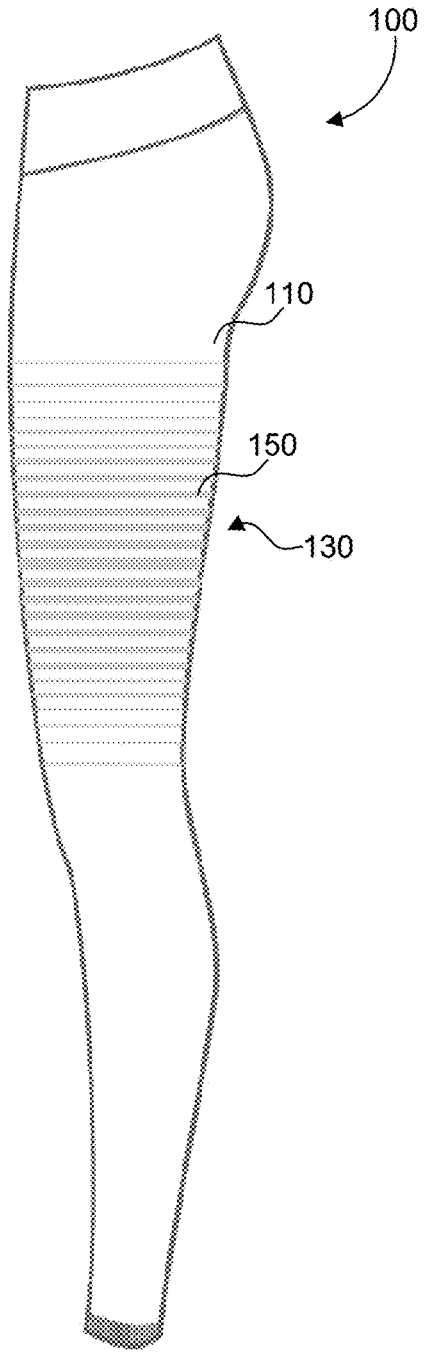
FIG. 1B shows a side view of the knit article according to FIG. 1A.

In some embodiments, a knit article 100 is knit using a first yarn 110 and may include at least a first region 130 having a reflective yarn 150, as shown for example in FIGS. 1A and 1B. Knit article 100 may be a sleeve, such as a shirt sleeve or a jacket sleeve, or knit article 100 may be a portion of a pair of tights or leggings, such as a leg portion, as shown in FIGS. 1A and 1B, among other articles of apparel. In alternate embodiments, knit article 100 may be a portion of a shoe or sneaker, such as an upper of a shoe or sneaker.

In some embodiments, knit article 100 may be manufactured by circular knitting. When circular knitting is used, knit article 100 is produced so as to have a tubular shape. Circular knitting provides the benefit of a seamless construction for a tubular article, whereas flat knitting requires the use of a seam to form a tubular structure from a flat article. In some embodiments, however, knit article 100 may be manufactured by flat knitting.

In some embodiments, knit article 100 may be weft knitted. Weft knitting generally produces a more elastic fabric than warp knitting. Knit article 100 may be knitted with a knit pattern, such as a plain stitch or single jersey pattern. In some embodiments, the knit pattern may be a double jersey pattern. In some embodiments, the knit pattern may be a jacquard pattern using two or more yarns, such as single jersey jacquard, as shown for example at FIG. 2. A single jersey jacquard pattern 200 may be formed using a first yarn 201 and a second yarn 202, in which a course includes first yarn 201 floated 210 at stitch positions having a stitch formed by second yarn 202, and second yarn 202 floated 212 at stitch positions having a stitch formed by first yarn 201.

Knit article 100 may be manufactured using a first yarn 110. First yarn 110 may be any of various types of yarn including natural yarns, such as cotton, fleece, linen, silk, or wool, synthetic yarns, such as nylon, acrylic, polyester, elastane (e.g., Lycra®) or combinations thereof. Further, first yarn 110 may have a coating such as a polymer coating to provide first yarn 110 with desired properties. The coating may be, for example, a hydrophobic coating or a flame-retardant coating. First yarn 110 can be a non-reflective yarn.

Figure 2:
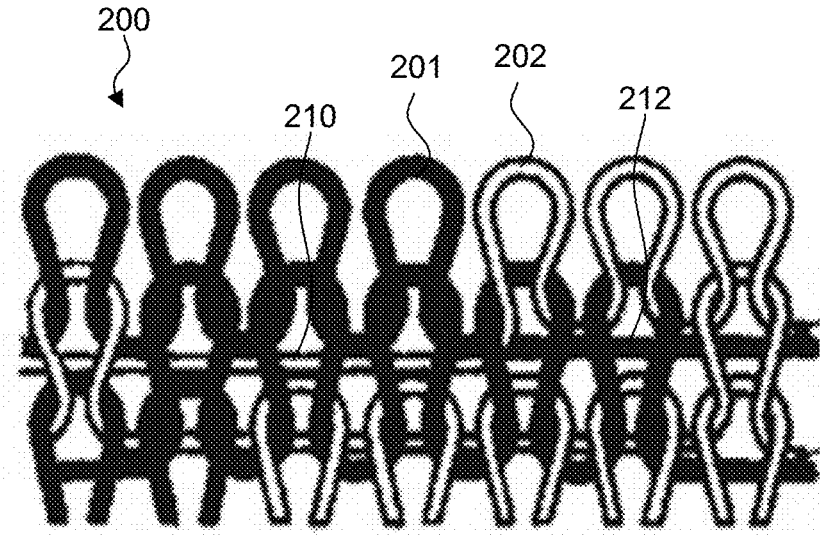
FIG. 2 shows a single jersey jacquard knitting pattern according to an embodiment.
Figure 3:
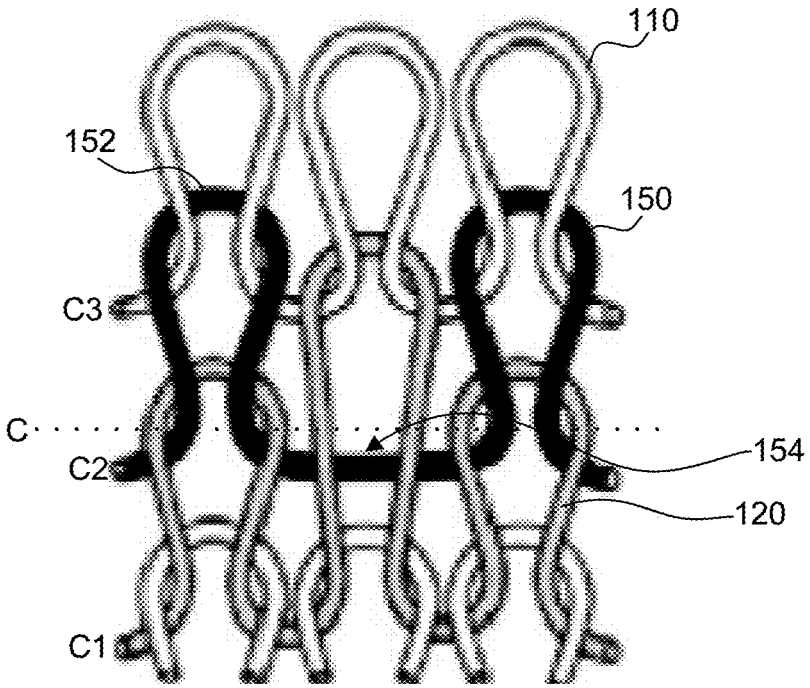
FIG. 3 shows a float stitch according to an embodiment.

In some embodiments, knit article 100 may be manufactured using a first yarn 110 and further a second yarn 120 (see FIG. 3). First yarn 110 and second yarn 120 may be different types of yarn and/or may have different properties. A "type" of yarn may be determined by the material, the composition (e.g., single filament, multi-filament, number of plies), and the weight per unit length as measured in dernier or dtex. First yarn 110 may have a first color and second yarn 120 may have a second color to provide a garment with a two-toned appearance. For example, knit article 100 may be knit so as to have a two-toned jacquard pattern, as shown in FIG. 2. First yarn 110 and second yarn 120 may be the same type of yarn or different types of yarn as required to produce a knit article 100 having the desired properties and appearance.

In some embodiments, knit article 100 includes a single knit layer 101. Knit layer 101 may be formed by one or more yarns as discussed above. Knit article 100 may include multiple knit layers, such as two or more knit layers. For example, multiple knit layers may be formed when knit article 100 is knitted so as to have a double jersey pattern. Forming a knit article 100 with multiple layers may be desired to provide a heavier or thicker knit article.

A reflective yarn 150 is knit into at least a region 130 of knit article 100. Reflective yarn 150 may be knit into a first region 130 of knit article 100 such that only a portion of knit article 100 incorporates reflective yarn 150. However, in some embodiments, reflective yarn 150 may be knit into two or more regions of knit article 100. First region 130 of knit article 100 may correspond to, for example, a lower portion or calf portion of a legging, a mid-portion or knee portion of a legging, or an upper portion or thigh portion of a legging. In some embodiments, first region 130 may be, for example, a lower portion or forearm portion of a sleeve, a mid-portion or elbow portion of a sleeve, or an upper portion or upper arm (biceps/triceps) portion of a sleeve.

In some embodiments, reflective yarn 150 is formed from strips or fibers of a reflective material and is covered by a polyester or nylon yarn. The reflective material may include glass beads. The yarn may include a core yarn of nylon and a sheath or film of polyester. The yarn may have a linear density of about 600 to about 700 Dtex, and in some embodiments may be about 630 to 650 Dtex.

Reflective yarn 150 is knit into knit article 100 in a direction transverse to a longitudinal axis of knit article 100. Thus, a tubular knit article 100 formed by circular knitting may include reflective yarn 150 knit circumferentially about knit article 100. Thus, reflective yarn 150 is knit along a course C of knit article 100, as shown in FIG. 3. In some embodiments, reflective yarn 150 may be knit along a plurality of courses C of knit article 100 so that first region 130 of knit article 100 is a reflective region. In some embodiments, reflective yarn 150 may be knit into knit article 100 so as to form a plurality of stripes. Reflective yarn 150 may be incorporated in a first course and a second course, wherein the first and second courses are spaced by at least one additional course. Further, a reflective yarn 150 may be incorporated into knit article 100 in a series of successive courses, and may be separated from a reflective yarn incorporated in another series of successive courses by one or more additional courses that lack reflective yarn 150.

Reflective yarn 150 may have a modulus of elasticity that is less than a modulus of elasticity of first yarn 110 and/or second yarn 120 in embodiments having second yarn 120. As a result, reflective yarn 150 is less flexible or stretchable than first yarn 110 and second yarn 120, and is relatively stiff. Knitting reflective yarn 150 into knit article 100 may reduce the flexibility or elasticity of the resulting knit article 100, which would be undesirable where the finished knit article is desired to have flexibility or stretchability, as is desirable in sportswear or athletic apparel.

In order to reduce the impact of reflective yarn 150 on the flexibility or stretchability of knit article 100, reflective yarn 150 is knit into knit article 100 with additional slack. As such, reflective yarn 150 has less tension than first yarn 110 (and/or second yarn 120 in embodiments having a second yarn 120). In some embodiments, reflective yarn 150 is knit into knit article 100 by float plaiting stitching to provide reflective yarn 150 with additional slack. A float is produced by a needle position, such as a needle position of a circular knitting machine, not forming a loop or stitch at the needle position, referred to as a "float," "float position," or "float stitch." The float position serves to integrate reflective yarn 150 into knit article 100 with additional slack, i.e., less tension, than first and second yarns 110, 120 used to form knit article 100. As a result of the additional slack provided to reflective yarn 150 by float plaiting stitching, the impact of reflective yarn 150 on the flexibility of knit article 100 is reduced or minimized. Reflective yarn 150 may include a float position 154 for every stitch position 152 (see FIG. 3), such that there is an alternating pattern of stitches and floats. In some embodiments, reflective yarn 150 may include one to six float positions for every stitch position, and thus reflective yarn 150 may be floated in a ratio of stitch positions 152 to float positions 154 of about 1:1 to 1:6.

Figure 7:
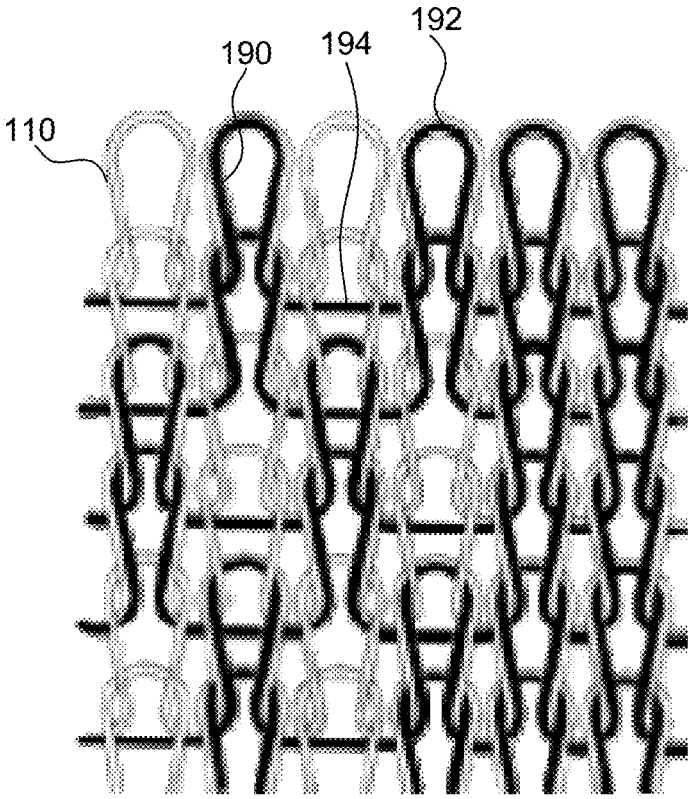
FIG. 7 shows a plaiting yarn pattern according to an embodiment.

In some embodiments, the method of manufacturing a garment having a reflective yarn may further include plaiting knit article 100 with one or more plaiting yarns 190, as shown at FIG. 7. A "plaited" structure includes stitches or loops that are composed of two or more yarns, e.g., the reflective yarn and a plaited (or plaiting) yarn. First region 130 of knit article 100 containing reflective yarn 150 may including plaiting yarn 190. In some embodiments, plaiting yarn 190 may be positioned on a technical back of knit article 100 corresponding to an interior of garment, such as an interior of a pair of leggings that contacts or faces toward the wearer's body. Plaiting yarn 190 covers reflective yarn 150 so that reflective yarn 150 does not contact the body of the wearer, and plaiting yarn 190 may provide a smooth, soft, or otherwise comfortable feel to the wearer. In some embodiments, plaiting yarn 190 may include one or more float positions 194. However, reflective yarn 150 may be fully plaited at each stitch position 192.

Figure 4:
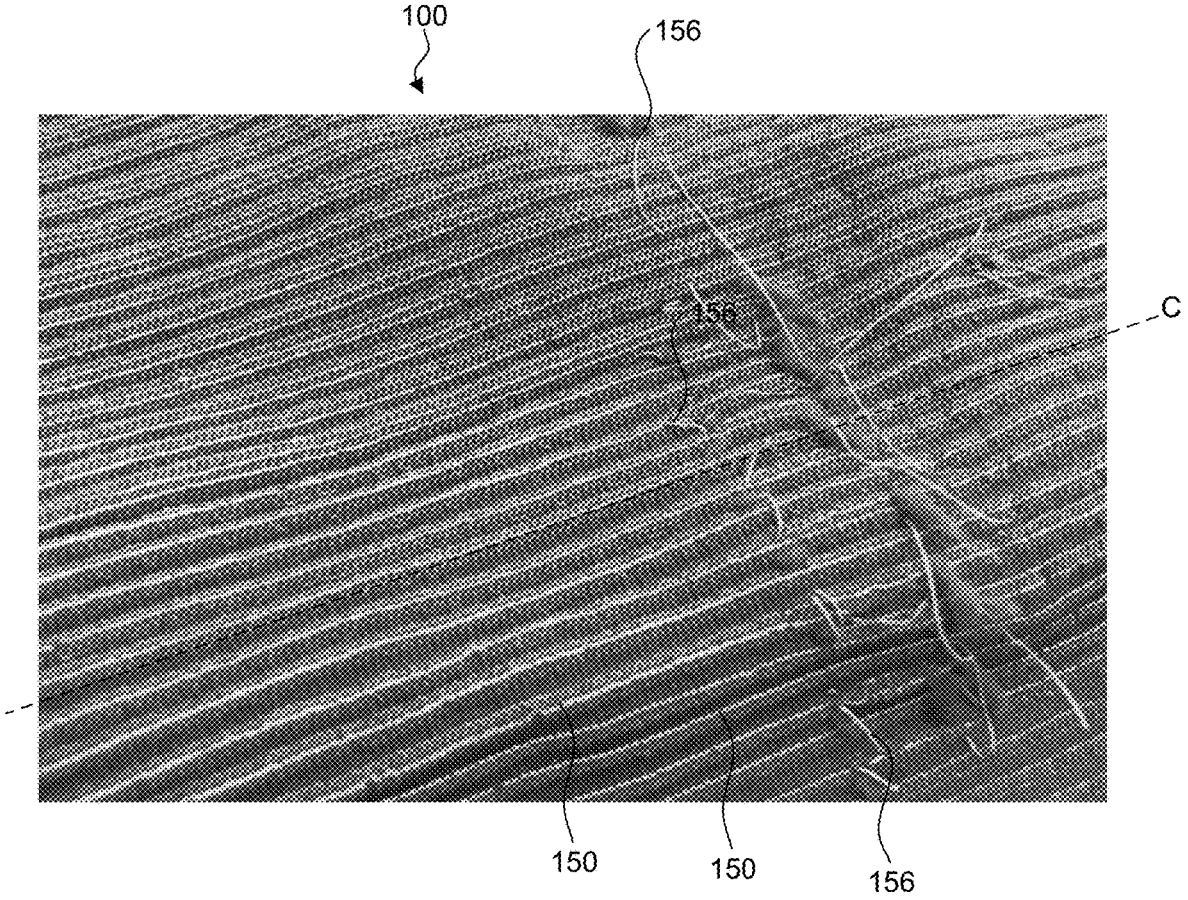
FIG. 4 shows a close-up view of end portions of a reflective yarn in a knit article according to an embodiment.

In order to prevent reflective yarn 150, and plaiting, from unraveling once incorporated into knit article 100, particularly when knit article 100 is stretched, reflective yarn 150 may be knit into knit article 100 such that end portions 156 of reflective yarn 150 extend outwardly from knit article 100 as extra or excess length of unused or unknitted yarn, as shown for example at FIG. 4. As a result, knit article 100 requires further finishing to secure reflective yarn 150 in knit article 100 and to remove the end portions 156 that extend from knit article 100 and provide an unfinished appearance.

Figure 5:
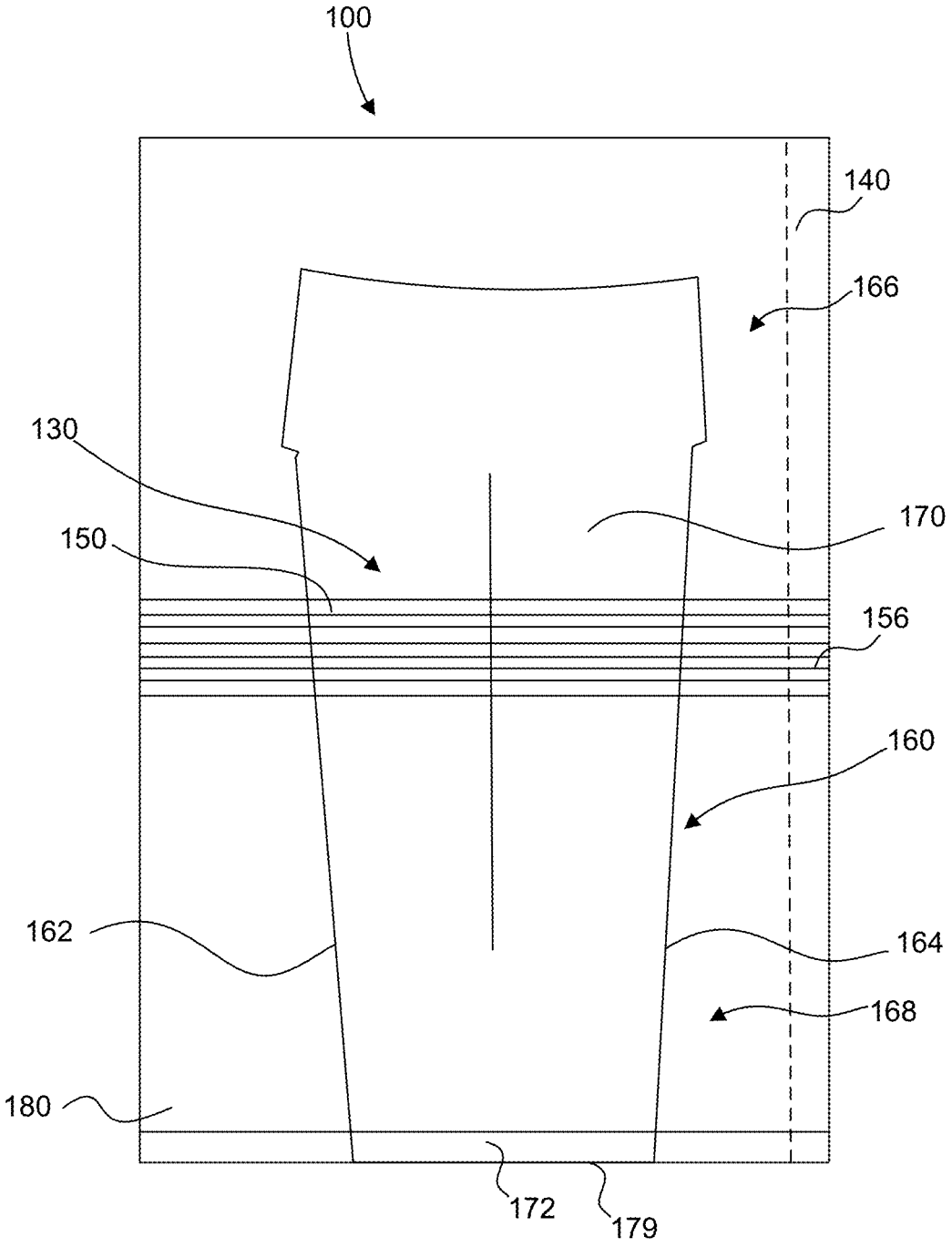
FIG. 5 shows a view of a pattern for forming a cut knit article according to an embodiment.

Knit article 100 incorporating reflective yarn 150 may be cut according to a predetermined pattern 160 for forming the finished knit article 100, such as a garment or a portion of a garment. In FIG. 5, for example, a pattern 160 for forming a leg of a pair of leggings is shown. Knit article 100 is cut along pattern 160 to provide a cut knit article 170 with a desired shape. Excess portions 180 of knit article 100 may be removed and recycled or discarded, and excess portions 180 do not form part of the finished knit article 100. Knit article 100 is cut such that end portions 156 of reflective yarn 150 positioned, for example, at line 140 are removed as excess portions 180. Thus, cut knit article 170 has a clean appearance with no excess yarn.

Cut knit article 170 includes a first edge 162 and an opposing second edge 164. Cut knit article 170 further includes an upper portion 166 corresponding to a hip or waist region of the legging and a lower portion 168 corresponding to a leg portion of the legging. By cutting knit article 100 based on pattern 160, end portions 156 of reflective yarn 150 are removed.

Once cut according to the desired pattern 160, cut knit article 170 is folded so that opposing first and second edges 162, 164 meet or overlap. The overlapping first and second edges 162, 164 of cut knit article 170 may be joined, such as by a seam so as to form a garment or a portion of a garment. Alternatively, the first and second edges 162, 164 need not overlap and may be joined in an end-to-end manner, such as via a butt seam having a straight or zig-zag stitch. In this way, reflective yarn 150 is secured within knit article 100 while retaining the slack provided by the float stitch such that finished knit article 100 retains flexibility and stretchability while incorporating a reflective yarn 150.

Figure 6:
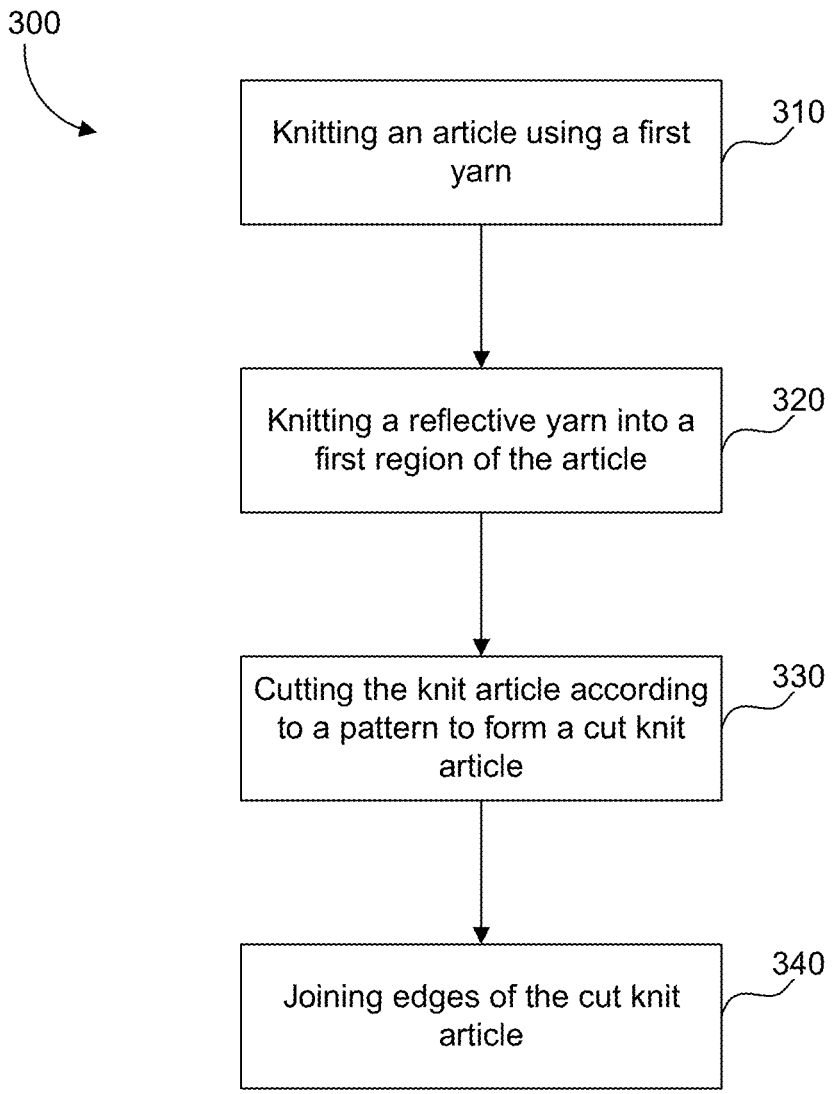
FIG. 6 shows a flow chart of a method for producing a knit article having a reflective yarn according to an embodiment.

In some embodiments, a method for manufacturing a garment having a reflective yarn 300 is shown at FIG. 6. The method 300 includes knitting a knit article 310 using a first yarn, such as by circular knitting. The knit article may be weft knit or warp knit. The knit article may be knit using a single first yarn, or may be knit using multiple yarns, such as a first yarn and a second yarn. The knit article may be knit so as to have a pattern, such as a jacquard pattern. The knit article may be knit in one or more layers.

The method further includes knitting knit article using a reflective yarn 320. Reflective yarn may be incorporated in only a portion of knit article, such as in a first region of knit article. The reflective yarn is knit using a float plaiting stitch so that the reflective yarn is not as tightly held in the knit article as the first yarn (and second yarn in embodiments using multiple non-reflective yarns). The knit article incorporating the reflective yarn is then cut according to a pattern for forming a cut knit article 330. End portions of reflective yarn are removed when cutting the knit article based on the pattern. The edges of the cut knit article are joined 340 so as to produce a garment or a portion of a garment, such as a leg of a pair of leggings, or a sleeve of a shirt. The cut knit article may be joined by overlapping the opposing first and second edges or by joining the first and second edges in an end-to-end manner, and securing the first edge to the second edge with a seam, so as to form the finished garment or a portion of a garment. In embodiments in which knit article is a portion of a garment, the knit article may be joined with the other portions of the garment to form the finished garment.

In some embodiments, knit article 100 may further include one or more welt stitches. As shown in FIG. 5, a lower end 179 of knit article 100 may include a seam or welt stitch 172. Welt stitch 172 may be formed on a circular knitting machine when knit article 100 is in a tubular form. Welt stitch 172 may serve as the lowermost portion of leggings, such as an ankle portion or cuff of the leggings. In some embodiments, welt stitch may serve as the wrist portion or cuff of a sleeve. Welt stitch 172 may have a ribbed structure. Welt stitch 172 may help to secure the end of knit article 100 and prevent unraveling or fraying of knit article 100. Welt stitch 172 may also be formed so as to adjust a length of a leg of a pair of leggings to a desired finished length for the leggings.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventors, and thus, are not intended to limit the present invention(s) and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, and without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance herein.

The breadth and scope of the present invention(s) should not be limited by any of the above-described exemplary embodiments, but should be defined only in accordance with the following claims and their equivalents.

What is claimed is:

1. A method of manufacturing a knit article having a reflective yarn, comprising:

knitting an article using a first yarn, wherein the first yarn is a non-reflective yarn;

knitting the reflective yarn and a plaiting yarn into a first region of the knit article using a float plaiting stitch, such that the reflective yarn is incorporated into the first region at a plurality of stitch positions separated by float positions, and the reflective yarn is plaited with the plaiting yarn at one or more of the plurality of stitch positions, wherein the plaiting yarn is positioned on a technical back of the knit article, wherein the reflective yarn is configured to increase visibility of the article, and wherein the reflective yarn has a first end portion and a second end portion that extend outwardly from the knit article to define excess length of the reflective yarn;

securing the reflective yarn to the knit article;

removing the first and second end portions of the reflective yarn;

cutting the article comprising the first yarn, the reflective yarn and the plaiting yarn according to a predetermined pattern to form a cut knit article having a first edge and an opposing second edge; and joining the first edge of the cut knit article to the second edge of the cut knit article.

2. The method of claim 1, wherein knitting the article comprises circular knitting.

3. The method of claim 1, wherein knitting the article comprises weft knitting.

4. The method of claim 1, wherein knitting the article comprises knitting using the first yarn and a second yarn.

5. The method of claim 4, wherein knitting the article comprises knitting a jacquard pattern.

6. The method of claim 1, wherein the article is a sleeve.

7. The method of claim 1, wherein the article is a legging.

8. The method of claim 1, wherein the first yarn has a first modulus of elasticity and the reflective yarn has a second modulus of elasticity that is less than the first modulus of elasticity.

9. The method of claim 1, comprising knitting the reflective yarn using a float stitch in a ratio of stitch positions to float positions of 1:1 to 1:6.

10. The method of claim 1, comprising knitting the reflective yarn into the knit article along a course of the article.

11. The method of claim 1, comprising knitting the reflective yarn into the knit article along a first course of the article, and knitting the reflective yarn into the knit article along a second course of the article, wherein the first course and the second course are spaced from one another by at least one additional course.

12. The method of claim 1, comprising joining the first edge and the second edge using a seam.

13. The method of claim 1, wherein the plaiting yarn covers the reflective yarn along the technical back of the knit article.

14. The method of claim 1, wherein the reflective yarn is plaited with the plaiting yarn at one or more of the plurality of float positions.

15. A method of manufacturing a knit article having a reflective yarn, comprising:

knitting an article using a first yarn having a first modulus of elasticity, and the reflective yarn having a second modulus of elasticity that is less than the first modulus of elasticity, wherein the reflective yarn is knit into a first region of the article using a float plaiting stitch such that the reflective yarn is incorporated into the first region at a plurality of stitch positions separated by float positions;

knitting a smooth plaiting yarn into the knit article at one or more of the plurality of stitch positions of the reflective yarn, wherein the plaiting yarn is positioned on a technical back of the article such that the plaiting yarn is configured to contact a skin of a wearer and to limit the reflective yarn from contacting the skin of the wearer;

cutting the article comprising the first yarn, the reflective yarn, and the plaiting yarn according to a predetermined pattern to form a cut knit article having a first edge and an opposing, second edge; and joining the first edge of the cut knit article to the second edge of the cut knit article.

16. The method of claim 15, further comprising knitting the reflective yarn into the article along a course of the article.

17. A knit article, comprising:

a knit layer comprising a first yarn and a second yarn, wherein the knit layer comprises a jacquard pattern; and a reflective yarn and a smooth plaiting yarn knit into a first region of the knit layer along a course of the knit layer by a float plaiting stitch such that the reflective yarn is incorporated into the first region at a plurality of stitch positions separated by float positions and the plaiting yarn is positioned on a technical back of the article and configured to contact a skin of a wearer;

wherein the first yarn has a first modulus of elasticity and the reflective yarn has a second modulus of elasticity that is less than the first modulus of elasticity.

18. The knit article of claim 17, wherein the reflective yarn is knit into the knit layer such that a ratio of stitch positions to float positions is 1:1 to 1:6.

19. The knit article of claim 17, wherein the knit article is a legging.

20. The knit article of claim 19, wherein the legging comprises a welt stitch at a lower end of the legging.

21. The knit article of claim 17, wherein the reflective yarn comprises glass beads.

* * * * *